United States Patent [19]

Vonach

[11] 4,382,720

[45] May 10, 1983

[54] INJECTION LINER FOR A BOREHOLE CLOSURE

[75] Inventor: Walter Vonach, Bregenz, Austria

[73] Assignee: Wilfried Scheiber, Kennelbach, Austria

[21] Appl. No.: 230,069

[22] Filed: Jan. 29, 1981

[30] Foreign Application Priority Data

Jan. 30, 1980 [AT] Austria ..... 488/80

[51] Int. Cl.[3] ..... E02D 5/18

[52] U.S. Cl. ..... 405/269; 52/744; 52/173 R; 425/12; 425/568; 425/DIG. 227; 141/293

[58] Field of Search ..... 405/269, 260, 258; 52/744, 173 R; 141/293; 264/36; 425/11-13, 109, 568, DIG. 227

[56] References Cited

U.S. PATENT DOCUMENTS

| | | | |
|---|---|---|---|
| 1,422,831 | 7/1922 | Camp | 405/269 X |
| 3,572,956 | 3/1971 | Liscum | 52/744 X |
| 3,861,155 | 1/1975 | Steinberg et al. | 405/260 |
| 3,986,536 | 10/1976 | Janson | 405/269 X |
| 4,289,427 | 9/1981 | Rolston | 405/260 |

FOREIGN PATENT DOCUMENTS

| | | | |
|---|---|---|---|
| 781127 | 3/1968 | Canada | 405/260 |
| 405767 | 2/1934 | United Kingdom | 405/269 |

*Primary Examiner*—Dennis L. Taylor

*Attorney, Agent, or Firm*—Toren, McGeady and Stanger

[57] ABSTRACT

An injection liner for use as a borehole closure in masonry or solid rock provides a passageway for injecting plastics material into a prepared borehole for sealing cracks or fissures in masonry or solid rock. The liner is a unitary shaft having a frusto-conically shaped outside surface arranged to be fitted into the prepared borehole. The shaft is a tubular member and provides an axially extending bore through which the plastics material is forced. A nipple is threaded into the larger diameter end of the shaft so that a hose for the plastics material can be connected to the nozzle for flowing the plastics material into the bore through the injection liner.

11 Claims, 2 Drawing Figures

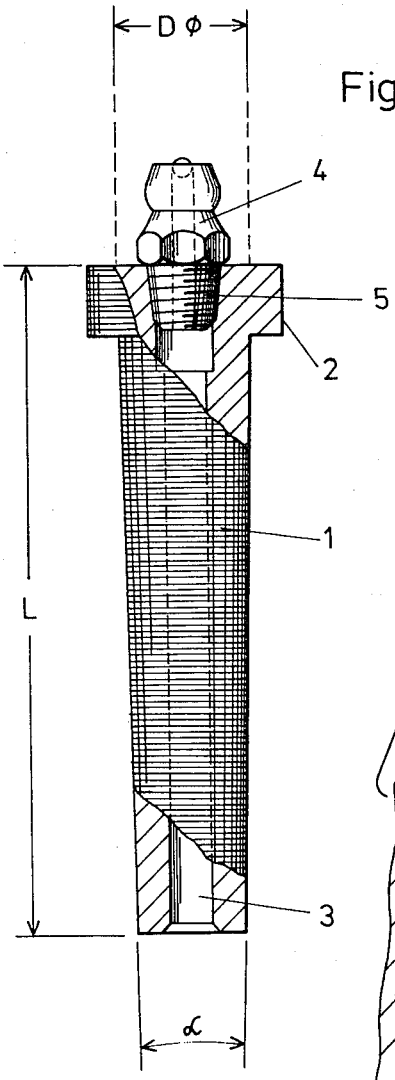
Fig. 1
Fig. 2
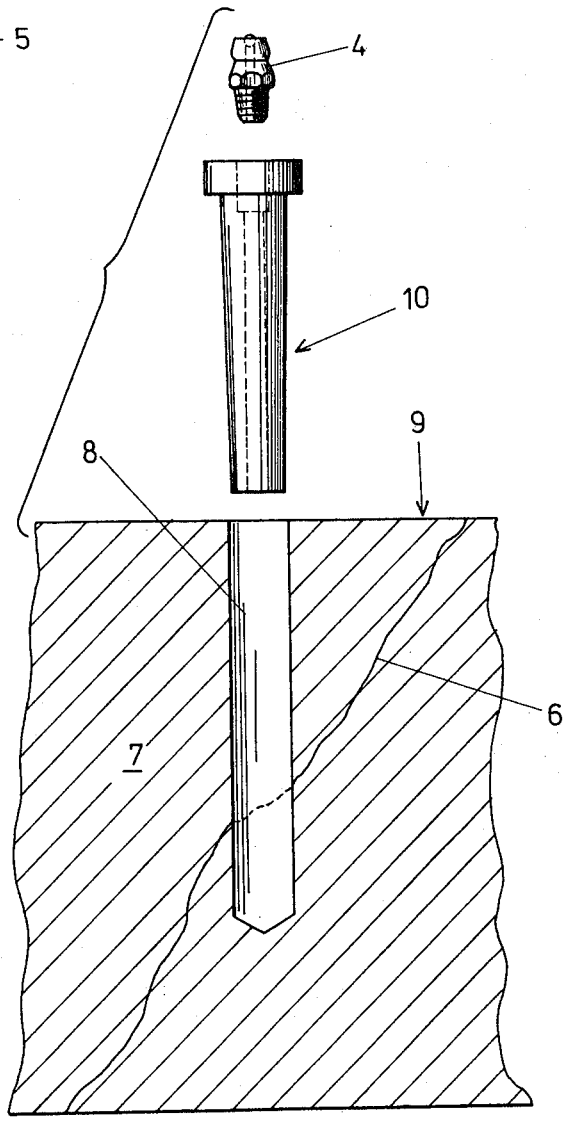

INJECTION LINER FOR A BOREHOLE CLOSURE

SUMMARY OF THE INVENTION

The present invention is directed to an injection liner used for forming a borehole closure in masonry or solid rock, the liner includes a connection nipple.

It is known to inject a plastics material into cracks or fissures in masonry or rock to seal the broken portions. Plastics materials used for this purpose are forced under high pressure into the cracks or fissures. Pressures of up to 200 bars are used. To press such plastics material into the cracks, fissures or crevices, a connecting member must be provided between the masonry or rock to be sealed and a hose or pipe through which the liquid plastics material is forced under high pressure. So-called injection liners are used as the connection members. In using such an injection liner a borehole is drilled in the masonry or rock in the region of the cracks or fissures. The borehole is arranged so that it intersects the crack at approximately half its length. Subsequently, the liner is inserted in the borehole and is secured so that it can absorb the reaction forces when the plastics material is forced into the borehole without the injection liner being pushed out of the borehole. After the injection liner is secured or braced in the borehole, a hose or pipe is connected to the outer end of the liner and, subsequently, the plastics material is forced in through the liner.

Injection liners of this type are known and consist of a small steel tube threaded at its ends. At one end a washer and a nut is fitted onto the threaded section. A piece of high-pressure rubber hose is slid onto the small tube with the length of the hose corresponding approximately to the distance between the two inner ends of the threaded section. A nut is screwed onto the other thread with a cylindrical pressure piece arranged between the nut and the rubber hose, possibly with the intermediate arrangement of a washer. The other end includes a connecting nipple, equipped with a female thread, which is fitted onto the upper end of the small steel tube. This liner is inserted into a borehole without any stress acting on the rubber hose. After insertion, the nut at the other end is tightened so that it presses against the rubber hose and has the tendency to cause the hose to be upset or forced outwardly. As a result, the liner is secured or braced within the borehole. Subsequently, the injection hose is connected and the material is forced in through the liner at pressures of up to 220 bars. When the injection procedure is concluded, the liner must be removed from the borehole. As a rule, it is not possible to pull the liner out of the borehole, accordingly, the portion of the liner protruding from the borehole must be cut off. This severing action is very time-consuming. The protruding portion must be laboriously knocked off with a chisel or it must be cut off by means of an expensive cutting disk. Furthermore, the known injection liner just described is of a complicated construction, since it involves eight separate pieces or elements. This liner has disadvantages with regard to its construction as well as to its use.

It is also known to impregnate the interior of a wooden member. In effecting the impregnation, a borehole is formed in the wooden member. A cylindrical, thin-walled sleeve is inserted into the borehole. The sleeve is formed of a plastics material and its outer edge has circumferential bulges which are spaced apart and are triangular in cross-section. At one end, the sleeve is closed by a cone with a filling opening, with a connecting member pressed into this conical closing member when the highly fluid impregnating agent is forced in. A small ball is placed within the sleeve and cannot be detached. After the impregnating agent is forced in, the small ball floats to the top and closes the filling hole in the conical closing member. Sleeves of this type, however, are only suitable for relatively soft materials (wood) and only for low pressures with the result that these known sleeves cannot be used for masonry and rock.

It is the primary object of the present invention to provide an injection liner for use as a borehole closure in masonry and solid rock which is of a simple construction such that its operativeness is not impaired. Further, another primary object is to provide a liner which is simple to manipulate. Accordingly, the manufacture of the injection line embodying the present invention can be effected at significantly lower costs as compared to the known embodiments.

In accordance with the present invention, the injection liner is formed of a frusto-conically shaped unitary tubular shaft member having an axially extending bore therethrough and the liner is made of an impact resistant plastics material. A nipple is threaded into the inlet end of the bore in the shaft member for connection to a hose or pipe for injecting the plastics material into the borehole.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawings:

FIG. 1 is a side elevational view, partly in section, of an injection liner embodying the present invention; and FIG. 2 is a view of the injection liner in FIG. 1 with its parts separated from one another and with the liner in position to be inserted into a borehole formed in a hard material.

DETAIL DESCRIPTION OF THE INVENTION

As shown in FIG. 1, the injection liner is formed as a unitary member of an impact resistant plastics material, for example, a suitable acetal resin, and includes a frusto-conical shaft portion with a leading end which is first inserted into a borehole and a trailing end. As viewed in FIGS. 1 and 2, the lower end is the leading end and the upper end is the trailing end. At the trailing end a cylindrical flange 2 is formed projecting laterally outwardly from the shaft 1. An axially extending bore 3 extends through the full length of the injection liner from the flange at the trailing end to the leading end. A connecting nipple 4 is inserted into the end of the axial bore 3 in the flange 2, that is, at the trailing end of the liner. Nipple 4 has a threaded frusto-conically shaped shaft 5 with a self-tapping thread. The shaft 5 extends into the trailing end of the bore through the liner with the remaining portion of the nipple extending outwardly from the trailing end. The length of the threaded shaft 5 corresponds approximately to the dimension of the flange 2 in the axial direction of the liner. The generating angle α of the frusto-conical shaft is about 4° or 5°, that is, the angle formed between two axially extending diametrically opposed lines in the outside surface of the shaft 1, however, the generating angle could be in the range of 3° to 7°. The length L of the liner is a multiple of the diameter of the shaft at the trailing end thereof, that is, about 5 to 7 times the diameter D as shown in FIG. 1. Further, as can be seen in FIG. 1, the diameter of the axially extending bore 3 through the liner corresponds approximately to the wall thickness of the tubular shaft. Injection liners of this type are used as the connecting member between a borehole formed in masonry or rock in which fissures or cracks are present and a section of pipe or hose through which a sealing or insulating compound is injected into the masonry or rock under high pressure. The preparation for carrying out such an injection is illustrated in FIG. 2.

In a masonry unit 7 having a crack 6 traversing its cross-section, a borehole is formed by a known drilling tool so that the borehole 8 intersects the crack 6 approximately half-way along its length. The injection liner 10 is inserted into the borehole and is driven in with one or more hammer blows. Because of its frusto-conical configuration the liner can be easily set into the borehole and then secured tightly in place. Fixing the liner in position can be performed with a manually operated hammer or with a power tool hammer. With the liner in place the nipple 4 is inserted into the trailing end of the bore through the liner with the nipple cutting its own thread in the bore. The insertion of the nipple is made possible because the threaded shaft is frusto-conical along with being self-tapping. The nipple is tightened into the liner with the full extent of the shaft 5 being in threaded engagement with the inner surface of the axial bore 3. The nipple is tightened by means of a suitable tool. Accordingly, it is unnecessary to provide a thread in the trailing end of the bore 3 through the liner. After the liner has been inserted in this manner, it is ready for use. The sealing compound or injection substance is pressed through the borehole at a pressure up to 220 bars and the substance travels from the leading end of the liner into the borehole and then into the crack 6.

As can be seen in FIG. 1, the outside surface of the frusto-conical shaft 1 is provided with grooves extending circumferentially around the shaft so that it has a roughened surface.

After the injection of the material into the borehole and the crack has been completed, the section of the liner protruding outwardly from the borehole is knocked off by means of a hammer blow struck from the side against the flange portion of the liner. In this regard, numerous tests have shown that the liner does not break in a plane flush with the outside surface of the masonry, rather, it breaks off at least ½ to 1 cm deeper. Therefore, after the protruding portion of the liner has been knocked off, an opening remains which can be easily plastered.

The advantages achieved by means of the present invention incorporated in the injection liner are obvious. An extremely simple construction of the injection liner is provided as compared to known liners, particularly since it consists of only two pieces, that is, the frusto-conical shaft 1 and the nipple 4. The liner can be driven into a borehole 8 by means of a hammer and does not have to be held in the borehole by another device as has been required in the past. In the case of boreholes 8 which spall off or are soft, there are no difficulties with respect to fixing the frusto-conical shaft. In the past, fixing the known injection liners has not always been an easy operation, since a new borehole had to be drilled. Since the injection liner is formed of an impact resistant plastics material, the connecting nipple with its self-tapping thread can be inserted into a smooth bore in the liner. After the liner has been used with the injected material filled into the borehole, each liner, which, as a rule, protrudes from the borehole by about 1 to 2 cm, must be cut off at least flush with the masonry surface, so that the borehole can be subsequently plastered. In conventional liners knocking off the protruding portion has involved a very time-consuming operation, since the protruding section must be removed by means of a chisel or by cutting it off using a cutting disk. The protruding portion of a liner embodying the present invention can be easily knocked off by a hammer without any difficulty merely by means of a laterally directed blow. This separating action is a surprise, since the liner is made from a tough impact resistant material. Since the injection liner embodying the present invention is of an extremely simple construction, its manufacture is also very simple. It can be produced as an injection molded part. The fact that its intended use is just as simple follows directly from the description. The injection liner, embodying the present invention, can be manufactured in various lengths and diameters with the injection liner being of a simple construction suitable for all types of applications.

While specific embodiments of the invention have been shown and described in detail to illustrate the application of the inventive principles, it will be understood that the invention may be embodied otherwise without departing from such principles.

What is claimed is:

1. Injection line for use as a borehole closure in masonry or rock including a nipple having a first axially extending threaded part and an axially extending second part extending from said first part for connecting said liner to a source of material to be injected into the borehole, said liner comprises an axially elongated unitary tubular shaft forming an axially extending bore therethrough, said shaft having a leading end arranged to be inserted first into the borehole and a trailing end arranged to be located adjacent to and outwardly from the opening into the borehole, said shaft is frusto-conically shaped and tapers inwardly from the trailing end to the leading end of said shaft so that said shaft can be placed into and then secured tightly in place within the borehole with the trailing end projecting from the borehole, said shaft is formed of an impact resistant plastics material, said first threaded part of said nipple is threaded into engagement within the trailing end of the bore through said shaft, whereby a material can be pressure injected through said nipple and liner into the borehole and after the completion of the material injection a sidewards hammer blow to the part of said liner protruding outwardly from the borehole can break off the protruding portion at a location slightly inwardly of the opening to the borehole.

2. Injection liner, as set forth in claim 1, wherein the axially extending outside surface of said frusto-conical shaft is roughened.

3. Injection liner, as set forth in claim 2, wherein the outside surface of said frusto-conical shaft is roughened by circumferential grooves formed therein.

4. Injection liner, as set forth in claim 1 or 2, wherein a cylindrical flange is formed integrally with the trailing end of said shaft, with said flange projecting radially outwardly from the outside surface of said shaft at the trailing end thereof.

5. Injection liner, as set forth in claim 4, wherein said flange has a length in the axial direction of said shaft from the trailing end thereof about equal to the axial length of said first threaded part on said nipple.

6. Injection liner, as set forth in claim 4, wherein said first threaded part of said nipple includes a self-tapping thread.

7. Injection liner, as set forth in claim 5, wherein said first threaded part on said nipple is frusto-conically shaped.

8. Injection liner, as set forth in claim 1, wherein the generating angle of said frusto-conical shaft of said liner is in the range of 3° to 7°.

9. Injection liner, as set forth in claim 1, wherein said liner having a length which is a multiple of the diameter of said shaft at the trailing end thereof.

10. Injection liner, as set forth in claim 8, wherein said liner having a length in the range of 5 to 7 times the diameter of said shaft of said liner at the trailing end thereof.

11. Injection liner, as set forth in claim 1, wherein the diameter of the axially extending bore through said liner corresponds approximately to the wall thickness of said tubular shaft.

* * * * *